US009778604B2

(12) United States Patent
Miyamoto et al.

(10) Patent No.: US 9,778,604 B2
(45) Date of Patent: Oct. 3, 2017

(54) IMAGE FORMING APPARATUS INCLUDING AN ELECTRIC CHARGE APPLYING UNIT

(71) Applicant: FUJI XEROX CO., LTD., Tokyo (JP)

(72) Inventors: Yoko Miyamoto, Ebina (JP); Tomoaki Yoshioka, Ebina (JP); Yasuhiro Shimada, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/238,832

(22) Filed: Aug. 17, 2016

(65) Prior Publication Data

US 2017/0212454 A1 Jul. 27, 2017

(30) Foreign Application Priority Data

Jan. 26, 2016 (JP) ..... 2016-012094

(51) Int. Cl.
*G03G 15/16* (2006.01)

(52) U.S. Cl.
CPC ..... *G03G 15/1665* (2013.01)

(58) Field of Classification Search
CPC ..... G03G 15/163; G03G 15/167; G03G 15/1665; G03G 15/1635; G03G 15/1695
USPC ..... 399/121, 313, 314
See application file for complete search history.

(56) References Cited

U.S. PATENT DOCUMENTS 6,253,041 B1 6/2001 Tomizawa et al.
7,945,176 B2 * 5/2011 Hoshino et al. ..... G03G 15/167 399/313
8,433,221 B2 * 4/2013 Minbe et al. ..... G03G 15/163 399/121

FOREIGN PATENT DOCUMENTS

JP H11-109762 A 4/1999
JP 2000-221807 A 8/2000
JP 2009-186589 A 8/2009
JP 2009-300929 A 12/2009

* cited by examiner

*Primary Examiner* — William J Royer
(74) *Attorney, Agent, or Firm* — Oliff PLC

(57) ABSTRACT

An image forming apparatus includes: an image carrier carrying a toner image; a transfer unit disposed to contact the image carrier and transferring the toner image carried on the image carrier to a recording medium; and a gap forming unit that forms a gap between the image carrier and the transfer unit when one or more regions of the recording medium are positioned between the image carrier and the transfer unit. The one or more regions include at least one of a leading end and a trailing end of the recording medium. The image forming apparatus further includes an electric charge applying unit disposed on an upstream side of the transfer unit and applies electric charges to the one or more regions of the recording medium. The electric charges have an opposite polarity to a charging polarity of a toner which forms the toner image.

2 Claims, 6 Drawing Sheets

IMAGE FORMING APPARATUS INCLUDING AN ELECTRIC CHARGE APPLYING UNIT

CROSS-REFERENCE TO RELATED APPLICATIONS

This application is based on and claims priority under 35 USC 119 from Japanese Patent Application No. 2016-012094 filed Jan. 26, 2016.

BACKGROUND

Technical Field

The invention relates to an image forming apparatus.

SUMMARY

According to an aspect of the invention, there is provided an image forming apparatus including: an image carrier that carries a toner image; a transfer unit that is disposed to contact the image carrier and transfers the toner image carried on the image carrier to a recording medium; a gap forming unit that forms a gap between the image carrier and the transfer unit when one or more regions of the recording medium are positioned between the image carrier and the transfer unit, wherein the one or more regions include at least one of a leading end and a trailing end of the recording medium along a transport direction of the recording medium; and an electric charge applying unit that is disposed on an upstream side of the transfer unit along the transport direction of the recording medium and applies electric charges to the one or more regions of the recording medium, wherein the electric charges have an opposite polarity to a charging polarity of a toner which forms the toner image.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described with reference to drawings.

Exemplary Embodiment 1

Figure 1:
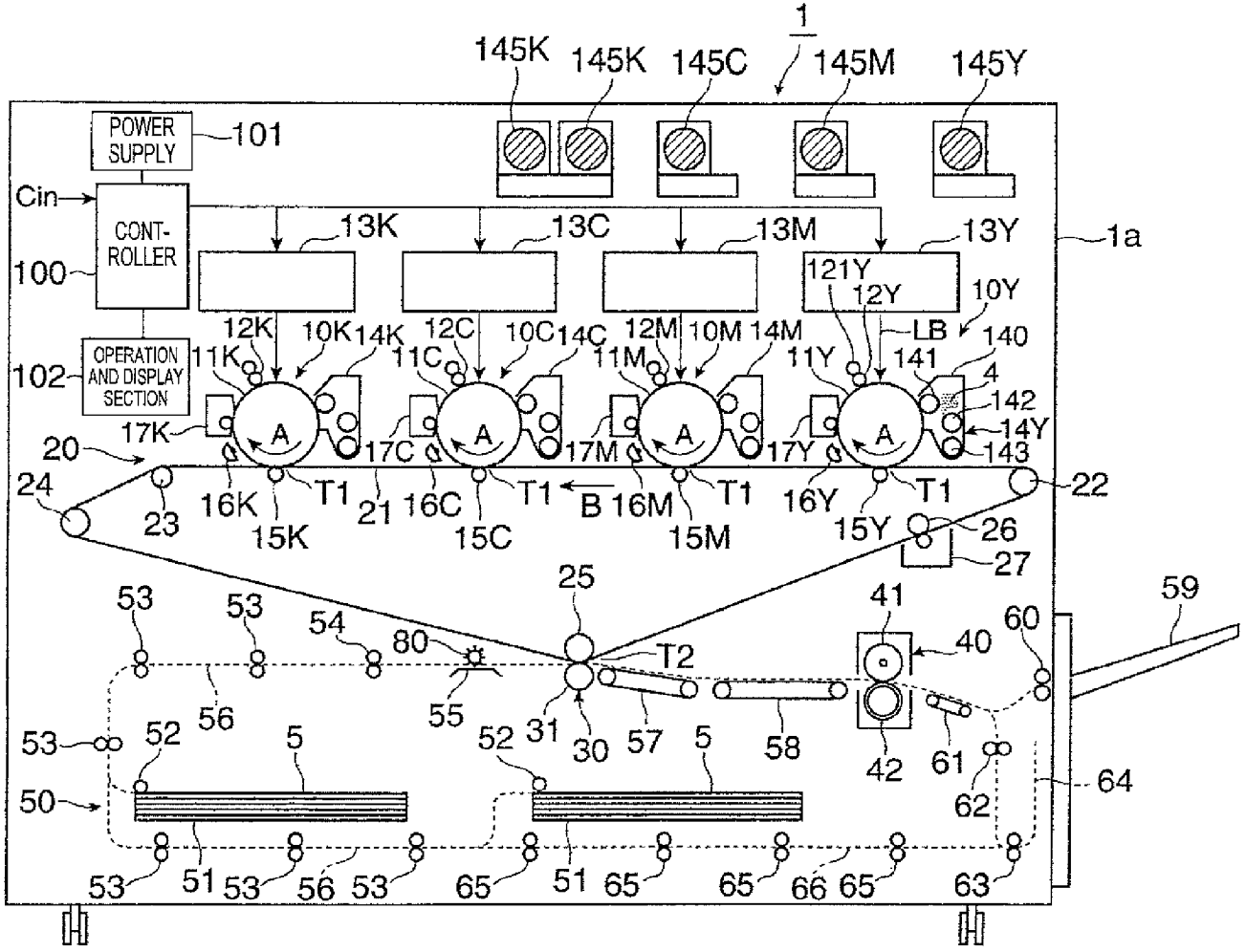
FIG. 1 is an overall configuration diagram illustrating an image forming apparatus according to an exemplary embodiment 1 of the invention.

FIG. 1 illustrates an overall overview of an image forming apparatus 1 according to an exemplary embodiment 1 of the invention.

Entire Configuration of Image Forming Apparatus

The image forming apparatus 1 according to the exemplary embodiment 1, for example, is configured as a color printer. The image forming apparatus 1 is provided with plural image forming devices 10Y, 10M, 10C, and 10K that form toner images which are developed by a toner constituting a developer 4, an intermediate transfer device 20 that respectively holds the toner images formed in each image forming device 10Y, 10M, 10C, and 10K and finally transports the toner images to a secondary transfer nip portion T2 which secondarily transfers the toner images to a recording paper 5 as an example of a recording medium, a paper feeding device 50 that stores and transports the required recording paper 5 to be supplied to the secondary transfer nip portion T2 of the intermediate transfer device 20 and a fixing device 40 that causes the toner image on the recording paper 5 which is secondarily transferred in the intermediate transfer device 20 to be fixed. In addition, the reference sign 1*a* in the figure represents a main body of the image forming apparatus 1. The main body 1*a* is formed with a support structure member and an exterior cover. The dashed line in the figure represents a main transport path in which the recording paper 5 is transported on the inner side of the main body 1*a*.

The image forming device 10Y, 10M, 10C, and 10K is configured with the four image forming devices 10Y, 10M, 10C and 10K that exclusively form four color toner images of yellow (Y), magenta (M), cyan (C) and black (K) respectively. These four image firming devices 10 (Y, M, C and K) are arranged to be in a state of being arranged in a row along the horizontal direction in the inner space of the main body 1*a*.

Each image forming device 10 (Y, M, C and K) is provided with a photoconductor drum 11 (Y, M, C, K) that rotates as an example of an image carrier. Each device as an example of a following toner image forming unit is mainly provided in the vicinity of the photoconductor drum 11 (Y, M, C, K). Main devices include a charging device 12 (Y, M, C, K), an exposure device 13 (Y, M, C, K), a developing device 14 (Y, M, C and K), a primary transfer device 15 (Y, M, C, K), a charge erase lamp 16 (Y, M, C and K), and a drum cleaning device 17 (Y, M, C and K). The charging device 12 (Y, M, C, K) charges a peripheral surface of the photoconductor drum 11 (Y, M, C, K) (image carrying surface) on which an image can be formed, to a desired potential. The exposure device 13 (Y, M, C, K) irradiates the charged peripheral surface of the photoconductor drum 11 (Y, M, C, K) with light which is based on image information (signal), to form an electrostatic latent image for each colors having a potential difference. The developing device 14 (Y, M, C, K) is an example of a developing unit and develops the electrostatic latent image with the toner of the developer 4 having a corresponding color (Y, M, C and K) to form the toner image. The primary transfer device 15 (Y, M, C, K) is an example of a primary transfer unit and transfers each toner image to the intermediate transfer device 20. The charge erase lamp 16 (Y, M, C, K) eliminates electric charges remaining on the image carrying surface of the photoconductor drum 11 (Y, M, C, K) after the primary transfer. The drum cleaning device 17 (Y, M, C, K) cleans the photoconductor drum 11 (Y, M, C, K) by removing residues such as toner remaining on and adhering to the image carrying surface of the photoconductor drum 11 (Y, M, C, K) after the primary transfer.

The photoconductor drum 11 (Y, M, C, K) forms the image carrying surface that includes a photoconductive layer (photosensitive layer) made of a photosensitive material on the grounded peripheral surface of the cylindrical or columnar base material. The photoconductor drum 11 (Y, M, C, K) is supported so as to rotate in a direction indicated by an arrow A after power is transmitted from a driving device (not illustrated).

The charging device 12 (Y, M, C, K) is configured with a contact type charging roll that is disposed to be in contact with the photoconductor drum 11 (Y, M, C, K). The charging device 12 (Y, M, C, K) includes a cleaning roll 121Y that cleans a front surface thereof. A charging voltage is supplied to the charging device 12 (Y, M, C, K). As the charging voltage, in a case where the developing device 14 (Y, M, C, K) performs a reversal development, voltage or current of the same polarity as the charging polarity of the toner supplied from the developing device 14 (Y, M, C, K) is supplied. In addition, as the charging device 12 (Y, M, C, K), a non-contact type charging device such as a scorotron which is disposed in a non-contact state on the front surface of the photoconductor drum 11 (Y, M, C, K) may be used.

The exposure device 13 (Y, M, C, K) irradiates the charged peripheral surface of the photoconductor drum 11 (Y, M, C, K) with light LB (indicated by a solid line having an arrow) that is generated in accordance with the image information input to the image forming apparatus 1, to form the electrostatic latent image. The exposure device 13 (Y, M, C, K) is provided with the exposure device 13 (Y, M, C and K) for each image forming device 10 (Y, M, C, K) of yellow (Y), magenta (M), cyan (C) and black (K). The image information (signal) corresponding to a full-color or monochrome image, that is input to the image forming apparatus 1 by any unit from a controller 100 when the latent image is formed is transmitted to the exposure device 13 (Y, M, C, K). In addition, as the exposure device 13 (Y, M, C, K), the exposure device 13 (Y, M, C, K) may also be used, having a light emitting diode (LED) print head that irradiates the photoconductor drum 11 (Y, M, C, K) with the light in accordance with the image information by an LED as plural light emitting elements which are disposed along the axial direction of the photoconductor drum 11 (Y, M, C, K) of each image forming device 10 (Y, M, C, K) to form the electrostatic latent image.

Each of the developing devices 14 (Y, M, C, K) is configured with a developing roll 141, a supply transport member 142, an agitation transport member 143, and a layer thickness regulation member (not illustrated) which are disposed in a device housing 140. The device housing 140 is formed with an opening portion and an accommodation chamber of the developer 4. The developing roll 141 is an example of a developer holding member. The developing roll 141 holds the developer 4 and transport the developer 4 to a developing region that faces the photoconductor drum 11 (Y, M, C, K). The supply transport member 142 is, for example, a screw auger. The supply transport member 142 supplies the developer 4 to the developing roll 141 while agitating the developer 4. The agitation transport member 143 is, for example, a screw auger. The agitation transport member 143 agitates and transports the developer 4 while exchanging the developer 4 with the supply transport member 142. The layer thickness regulation member regulates an amount of the developer 4 (layer thickness) held on the developing roll 141. Two-component developers that include non-magnetic toner and a magnetic carrier are used, for example, as each developer 4 (Y, M, C and K) of four colors.

The primary transfer device 15 (Y, M, C and K) is a contact type transfer device that includes a primary transfer roll which is in contact with and rotates via an intermediate transfer belt 21 in the vicinity of the photoconductor drum 11 (Y, M, C, K), and in which primary transfer voltage is supplied. As the primary transfer voltage, a DC voltage that indicates a reverse polarity to the charging polarity of the toner is supplied from a power supply device (not illustrated).

The charge erase lamp 16 (Y, M, C, K) is designed to eliminate residual electric charges on the front surface of the photoconductor drum 11 (Y, M, C, K) by uniformly exposing the front surface of the photoconductor drum 11 (Y, M, C, K) after the primary transfer is completed.

The drum cleaning device 17 (Y, M, C, K) is configured with a main body having a container shape, a cleaning plate, and a delivery member. The main body is partially opened. The cleaning plate is disposed so as to be in contact with the peripheral surface of the photoconductor drum 11 (Y, M, C, K) at a required pressure after the primary transfer, to clean the photoconductor drum 11 (Y, M, C, K) by removing residues such as residual toner. The delivery member is, for example, a screw auger. The delivery member recovers the residues such as toner removed by the cleaning plate and transports the residues so as to feed the residues to a recovery system (not illustrated).

The intermediate transfer device 20, as illustrated in FIG. 1, is disposed to be present at a position of the lower side of the respective image forming device 10 (Y, M, C and K). The intermediate transfer device 20 is mainly configured with the intermediate transfer belt 21, plural belt support rolls 22 to 26, a secondary transfer device 30, and a belt cleaning device 27. The intermediate transfer belt 21 is an example of the image carrier. The intermediate transfer belt 21 rotates in the direction indicated by the arrow B while passing through a primary transfer nip portion T1 between the photoconductor drum 11 (Y, M, C, K) and the primary transfer device 15 (Y, M, C, K) (primary transfer roll). The belt support rolls 22 to 26 rotatably support the intermediate transfer belt 21 by holding the intermediate transfer belt 21 from an inner surface thereof in a desired state. The secondary transfer device 30 is an example of a secondary transfer unit. The secondary transfer device 30 is disposed on an outer peripheral surface (image carrying surface) side of the intermediate transfer belt 21 supported by the intermediate transfer belt 21 support roll 25 and secondarily transfers the toner image on the intermediate transfer belt 21 to the recording paper 5. The belt cleaning device 27 cleans the belt by removing residues such as the toner and paper dust which remain on and adhere to the outer peripheral surface of the intermediate transfer belt 21 which has passed through the secondary transfer device 30.

As the intermediate transfer belt 21, for example, an endless belt which is made of a material obtained by dispersing a resistance adjusting agent such as carbon black to a synthetic resin such as a polyimide resin and a polyamide resin is used. The belt support roll 22 is configured as a driving roll that is driven to rotate by the driving device (not illustrated). The belt support roll 23 is configured as a surfacing roll that forms an image forming surface of the intermediate transfer belt 21. The belt support roll 24 is configured as a tension applying roll that applies tension to the intermediate transfer belt 21 and a belt meandering correction roll that corrects the belt walk of the intermediate transfer belt 21. The belt support roll 25 is configured as a rear surface support roll of the secondary transfer. The belt support roll 26 is configured as a facing roll of the belt cleaning device 27.

Figure 2:
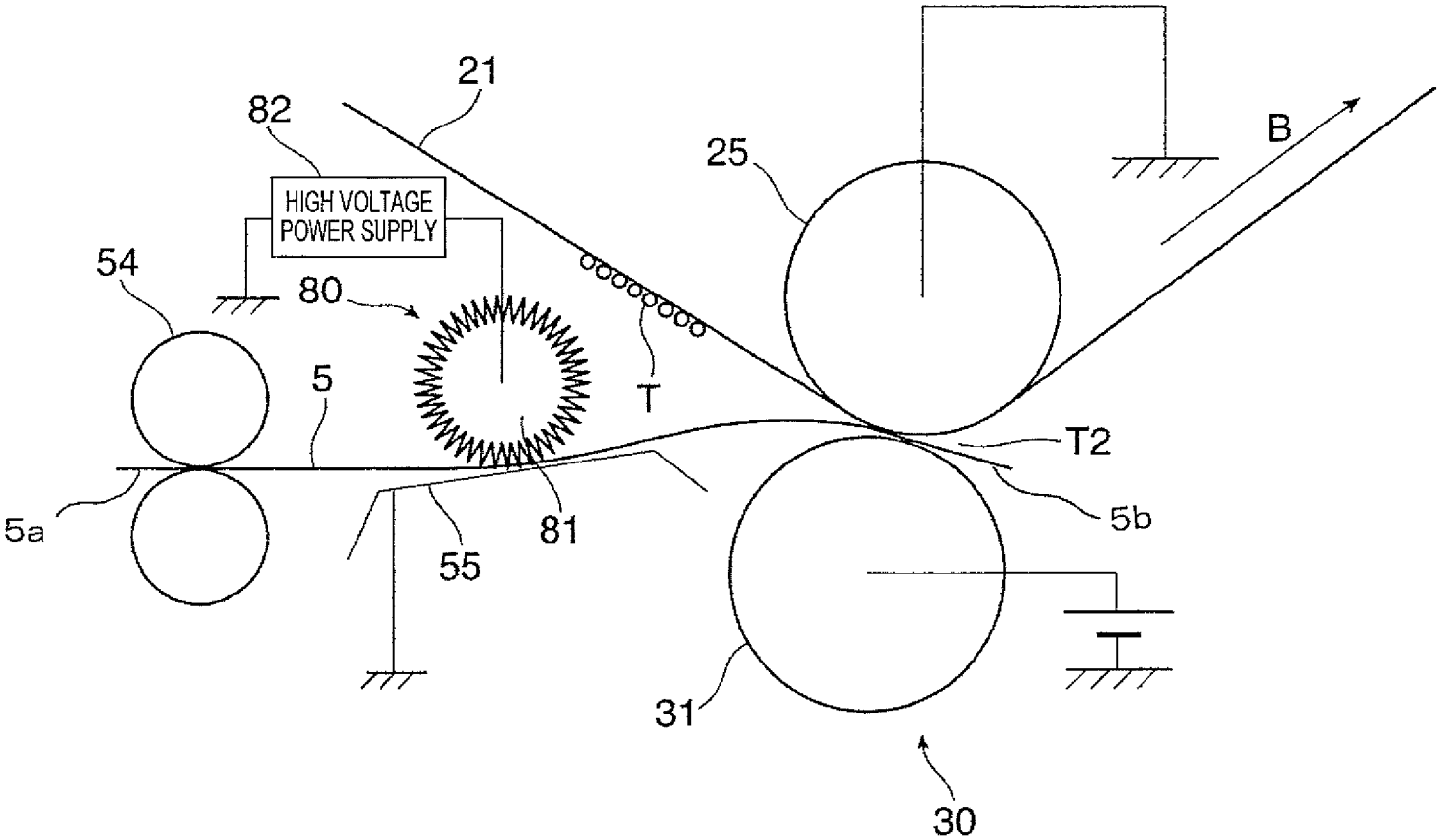
FIG. 2 is a configuration diagram illustrating a principal portion of the image forming apparatus according to the exemplary embodiment 1 of the invention.

The secondary transfer device 30 is the contact type transfer device that includes a secondary transfer roll 31 constituting the secondary transfer unit which rotates in contact with the peripheral surface of the intermediate transfer belt 21, and in which the secondary transfer voltage is supplied in the secondary transfer nip portion T2 which is the outer peripheral surface portion of the intermediate transfer belt 21 supported by the belt support roll 25 in the intermediate transfer device 20. The secondary transfer roll 31 is disposed so as to be in contact with the belt support roll 25 of which a position is fixed at a required pressing force via the intermediate transfer belt 21. The secondary transfer device 30 is configured with the secondary transfer roll 31 and the belt support roll 25 as the rear surface support roll. A DC voltage is supplied to the secondary transfer roll 31 or the belt support roll 25 as the secondary transfer voltage. The DC voltage has the same polarity as or the opposite polarity to the charging polarity of the toner. In the exemplary embodiment, as illustrated in FIG. 2, a DC high voltage having the opposite polarity (positive polarity) to the charging polarity of the toner is applied to the secondary transfer roll 31 as the secondary transfer voltage. The belt support roll 25 is connected (grounded) to a ground. In addition, without being limited thereto, the DC high voltage of the same polarity (negative polarity) as the charging polarity of the toner may be applied as the secondary transfer voltage in the belt support roll 25 and may be configured to connect (ground) the secondary transfer roll 31 to a ground.

The belt cleaning device 27 is configured in the same manner as the drum cleaning device 17 (Y, M, C, K). The belt cleaning device 27 is configured with a main body having a container shape, a cleaning plate (not shown), and a delivery member (not shown). The main body is partially opened. The cleaning plate is disposed so as to be in contact with the peripheral surface of the intermediate transfer belt 21 at a required pressure after the secondary transfer, to clean the intermediate transfer belt 21 by removing residues such as residual toner. The delivery member is, for example, a screw auger. The delivery member recovers the residues such as toner removed by the cleaning plate and transports the residues so as to feed the residues to the recovery system.

The fixing device 40 is configured to be disposed with a heating rotating body 41 with a roll form or a belt form that is heated by a heating unit so that a surface temperature is held at a required temperature, and a pressurizing rotating body 42 with the roll form or the belt form that rotates in contact with the heating rotating body 41 at a predetermined pressure in a state of being substantially along in the axial direction of the heating rotating body 41. The fixing device 40 is a fixing process portion of which a contact portion in which the heating rotating body 41 and the pressurizing rotating body 42 are in contact with each other performs the required fixing process (heating and pressurizing).

The paper feeding device 50 is disposed to be present at the position of the lower side of the intermediate transfer device 20. The paper feeding device 50 is mainly configured with plural (or single) sheet storage members 51 that store the recording paper 5 in a state where the recording paper 5 of a desired size and type is stacked there, and a feeding device 52 that feeds the recording paper 5 from the sheet storage member 51 one by one. The sheet storage member 51, for example, is attached so that the sheet storage member 51 may be drawn to the front surface of the main body 1*a* (side surface where a user faces when operating the main body 1*a*).

As the recording paper 5, for example, plain paper which is used in an electrophotographic copying machine and the printer, thin paper such as tracing paper or an OHP sheet are provided. In order to further improve smoothness of the image surface after fixing, it is preferable that the front surface of the recording paper 5 is also as smooth as possible. For example, it is possible to preferably use a coated paper that performs coating on the front surface of the plain paper with a resin, and so-called cardboard having a relatively high basis weight such as art paper for printing. The cardboard includes rough paper having an uneven surface, without being limited to the paper having a smooth surface. Here, the recording paper 5 having the basis weight less than 80 g/m$^2$ is referred to as thin paper, the recording paper 5 having the basis weight equal to or larger than 80 g/m$^2$ and less than 100 g/m$^2$ is referred to as plain paper, the recording paper 5 having the basis weight equal to or larger than 100 g/m$^2$ and less than 200 g/m$^2$ is referred to as first cardboard, and the recording paper 5 having the basis weight equal to or larger than 200 g/m$^2$ is referred to as second cardboard. It should be noted that basis weight thresholds that classify the thin paper, the plain paper and the first and second cardboard are just an example and are not limited to the above values. The cardboard, without being classified into the first and second cardboard, may simply be classified as one type of the cardboard, as a matter of course.

A sheet feeding transport path 56 that is configured with plural (or single) pairs of sheet transport rolls 53 and 54 and a transporting guide 55 which transports the recording paper 5 fed from the paper feeding device 50 to the secondary transfer nip portion T2 is disposed between the paper feeding device 50 and the secondary transfer device 30. The pair of sheet transport rolls 54, for example, is configured as the roll (registration roll) that adjusts a transport time of the recording paper 5 to the secondary transfer nip portion T2. Two series of transport belts 57 and 58 are disposed between the secondary transfer device 30 and the fixing device 40. The transport belts 57 and 58 transport the recording paper 5 which has been subjected to the secondary transfer and which is fed from the secondary transfer roll 31 of the secondary transfer device 30, to the fixing device 40. Furthermore, a pair of sheet exit rolls 60 so as to exit the recording paper 5 after the fixing that is fed from the fixing device 40 to a sheet exit portion 59 that is disposed at the side surface of the main body 1*a* is disposed at a portion near an exit port of the recording paper 5 that is formed on the main body 1.

A short transport belt 61 and a switching gate (not illustrated) that switches the sheet transport path are provided between the fixing device 40 and the pair of sheet exit rolls 60. In a case where the image is formed on both sides of the recording paper 5, a transport direction of the recording paper 5 in which an image is formed on the one side is switched to the lower side by the switching gate. The recording paper 5 is once transported to a reversing passage 64 having the pairs of sheet transport rolls 62 and 63. The recording paper 5 of which the front and back are reversed by reversing the transport direction from the reversing passage 64 while the pair of sheet transport rolls 63 holding an end portion of the recording paper 5, is transported to the normal sheet feeding transport path 56 via a duplex transport path 66 that is configured with plural pairs of sheet transport rolls 65 or the transporting guide (not illustrated).

Reference numerals 145 (Y, M, C and K) in FIG. 1 respectively represent plural toner cartridges that are arranged along a direction perpendicular to the paper surface and store the developer 4 that includes at least the toner which is supplied to the corresponding developing device 14 (Y, M, C and K).

The reference numeral 100 in FIG. 1 represents the controller that totally controls the operation of the image forming apparatus 1. The controller 100 is provided with a central processing unit (CPU, not illustrated), a read only memory (ROM) or a random access memory (RAM) or a bus and a communication interface that connect the CPU or the ROM.

After performing the required image process for an image signal Cin input from the outside, the controller 100 outputs the image signal corresponding to the exposure device 13 (Y, M, C and K) for each image forming device 10 (Y, M, C, K) of yellow (Y), magenta (M), cyan (C) and black (K).

The reference numeral 101 represents a power supply to supply the power to the controller 100 and the reference numeral 102 represents an operation and display section for a user to operate the image forming apparatus 1, respectively. The operation and display section 102 is provided with a designation unit (not illustrated) by which the user designates the recording paper 5 used for image formation. The plain paper, the thin paper or the cardboard (including the rough paper) as the size of the recording paper 5 and the type of the recording paper 5 is designated in the operation and display section 102. In addition, the controller 100 may be configured to automatically determine the size of the recording paper 5 and distinguish whether the recording paper 5 is the plain paper, the this paper, or the cardboard, based on the signal from an identification unit (not illustrated) provided in the sheet storage member 51.

Operation of Image Forming Apparatus

Hereinafter, a basic image-forming operation according to the image forming apparatus 1 will be described.

Here, the operation of forming a full-color image that is configured by a combination of the toner image with the four colors (Y, M, C and K) will be described by using the four image forming devices 10 (Y, M, C and K).

When the controller 100 receives the instruction information for the requested image forming operation (printing) that designates the recording paper 5 from the operation and display section 102, the four image forming devices 10 (Y, M, C and K), the intermediate transfer device 20, the secondary transfer device 30, and the fixing device 40 are started in the image forming apparatus 1.

Each photoconductor drum 11 (Y, M, C, K) firstly rotates in the direction indicated by the arrow A and each charging device 12 (Y, M, C, K) causes the front surface of each photoconductor drum 11 (Y, M, C, K) to respectively be charged to the required polarity (negative polarity in the exemplary embodiment 1) and the potential in each image forming device 10 (Y, M, C and K). Additionally, the exposure device 13 (Y, M, C and K) irradiates the charged front surface of the photoconductor drum 11 (Y, M, C, K) with the light LB which is emitted based on the image signal obtained by converting the image signal Cin which is input to the image forming apparatus 1 into each color component (Y, M, C and K), and respectively forms the electrostatic latent image of each color component configured with the required potential difference on the front surface thereof.

Additionally, each image forming device 10 (Y, M, C and K) performs the developing by the toner of the corresponding color (Y, M, C and K) which is charged to the required polarity (negative polarity) being respectively supplied from the developing roll 141 and electrostatically adhered to the electrostatic latent image of each color component formed in the photoconductor drum 11 (Y, M, C, K). By the developing, the electrostatic latent image of each color component formed in each photoconductor drum 11 (Y, M, C, K) is visualized as the toner image of four colors (Y, M, C and K) which is respectively developed by the toner of the corresponding color.

Additionally, when the toner image of each color formed on the photoconductor drum 11 (Y, M, C, K) of each image forming device 10 (Y, M, C and K) is transported to the primary transfer nip portion T1, the primary transfer device 15 (Y, M, C, K) is primarily transferred in a state of being superimposed in order with respect to the intermediate transfer belt 21 which rotates the toner image of each color in the direction indicated by the arrow B of the intermediate transfer device 20.

In each image forming device 10 (Y, M, C, K) in which the primary transfer is completed, after the charge erase lamp 16 (Y, M, C, K) removes the electric charges remaining on the front surface of the photoconductor drum 11 (Y, M, C, K), the drum cleaning device 17 (Y, M, C, K) removes the residues so as to scrape the residues and cleans the front surface of the photoconductor drum 11 (Y, M, C, K). Thereby, each image forming device 10 (Y, M, C, K) is brought into a state where the next image forming operation is possible.

Additionally, the intermediate transfer device 20 holds the toner image which is primarily transferred by the rotation of the intermediate transfer belt 21 and transports the toner image to the secondary transfer nip portion T2. On the other hand, the paper feeding device 50 feeds the required recording paper 5 such as the plain paper or the cardboard designated in the operation and display section 102 in accordance with the image forming operation to the sheet feeding transport path 56. The pair of sheet transport rolls 54 as the registration rolls supplies the paper by feeding the recording paper 5 to the secondary transfer nip portion T2 via the transporting guide 55 in accordance with the transfer time in the sheet feeding transport path 56.

The secondary transfer roll 31 of the secondary transfer device 30 causes the toner image on the intermediate transfer belt 21 to be secondarily transferred onto the recording paper 5 collectively in the secondary transfer nip portion T2. The belt cleaning device 27 cleans the intermediate transfer belt 21 by removing the residues such as the toner remaining on the front surface of the intermediate transfer belt 21 after the secondary transfer in the intermediate transfer device 20 which has been subjected to the secondary transfer.

Additionally, the recording paper 5 to which the toner image is secondarily transferred is transported via the two series of the transport belts 57 and 58 to the fixing device 40 after being peeled from the intermediate transfer belt 21 and the secondary transfer roll 31. In the fixing device 40, the recording paper 5 which has been subjected to the secondary transfer is introduced into and passes through the contact portion between the rotating heating rotating body 41 and the rotating pressurizing rotating body 42 to thereby perform the necessary fixing process (heating and pressurizing). As a result, the unfixed toner image is fixed on the recording paper 5. Lastly, when the image forming operation forms an image on only one side of the recording paper 5, the recording paper 5 subjected to the fixing is ejected to the sheet exit portion 59 disposed on the side of the main body 1*a* by the pair of sheet exit rolls 60.

When forming the image on both sides of the recording paper 5, without exiting the recording paper 5 having an image formed on one side to the sheet exit portion 59 by the pair of sheet exit rolls 60, the transport direction of the recording paper 5 is switched to the lower side by the switching gate (not illustrated). After the recording paper 5 is reversed by the reversing passage 64 having the pairs of sheet transport rolls 62 and 63, the recording paper 5 transported to the lower side is transported to the sheet feeding transport path 56 via the duplex transport path 66. The pair of sheet transport rolls 54 feeds the paper to supply the recording paper 5 to the secondary transfer nip portion T2 in accordance with the transfer time and transfers the image to fix the image on a rear surface of a recording paper 5. Then the pair of sheet exit rolls 60 exits the recording paper 5 to the sheet exit portion 59 disposed at the side of the main body 1*a*.

With the above operation, the recording paper 5 in which a full-color image configured by combining the toner images of the four colors is formed is output.

Configuration of Characteristic Parts of Image Forming Apparatus

Incidentally, in the image forming apparatus 1 configured as described above, the first or second cardboard having the basis weight relatively higher than that of the plain paper is used as the recording paper 5 in addition to the plain paper. The rough paper having an uneven portion on the front surface may be used as the cardboard.

In the image forming apparatus 1, as illustrated in FIG. 2, during the secondary transfer of the toner image T from the intermediate transfer belt 21 to the recording paper 5 by using the secondary transfer roll 31, a load on the intermediate transfer belt 21 which is travelling may be rapidly changed at a time when the recording paper 5 made of the cardboard enters the secondary transfer nip portion T2 or at a time when the recording paper 5 exits from the secondary transfer nip portion T2, and a speed of the intermediate transfer belt 21 may vary. As a result, an image defect which is so-called banding may occur in an image to be transferred onto the recording paper 5. The image defect known as the applied banding tends to more significantly occur as the basis weight of the cardboard becomes higher.

In order to suppress an occurrence of this image defect known as the banding, it has already been proposed to insert a gap forming member between an image carrier and a transfer member by a gap forming member driving unit when the cardboard enters or exits from the secondary transfer nip portion T2 (JP-A-2009-186589).

However, if the image forming apparatus is configured so that when the cardboard enters or exits from the secondary transfer nip portion T2, a gap is formed between the image carrier and the transfer member, transfer failure may occur at a leading end and a trailing end, in the transport direction, of the recording paper 5 having a front surface which is not smooth like the rough paper and having a lower density than a normal cardboard has.

Figure 3A:
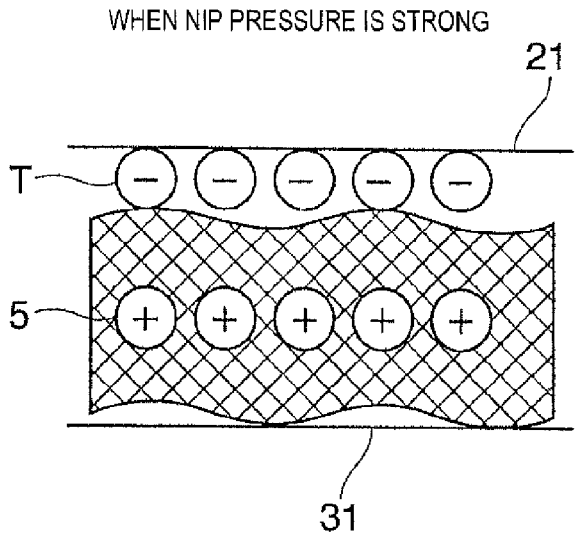
FIGS. 3A and 3B are schematic diagrams illustrating a toner image transferred onto a recording paper.
Figure 3B:
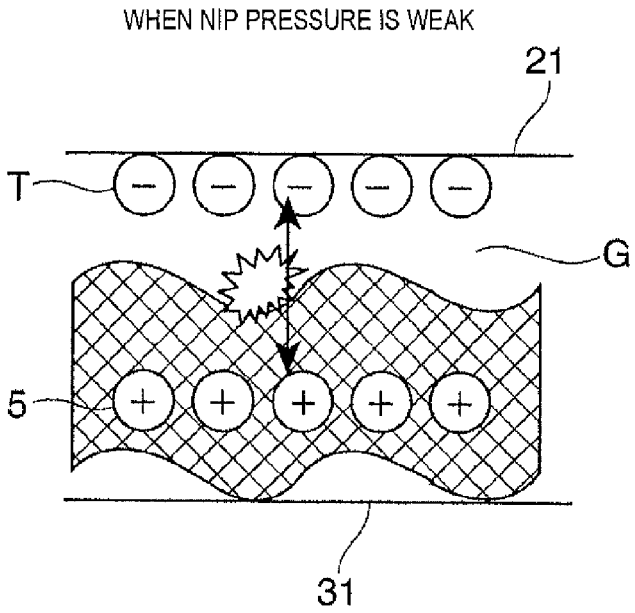
Figure 4:
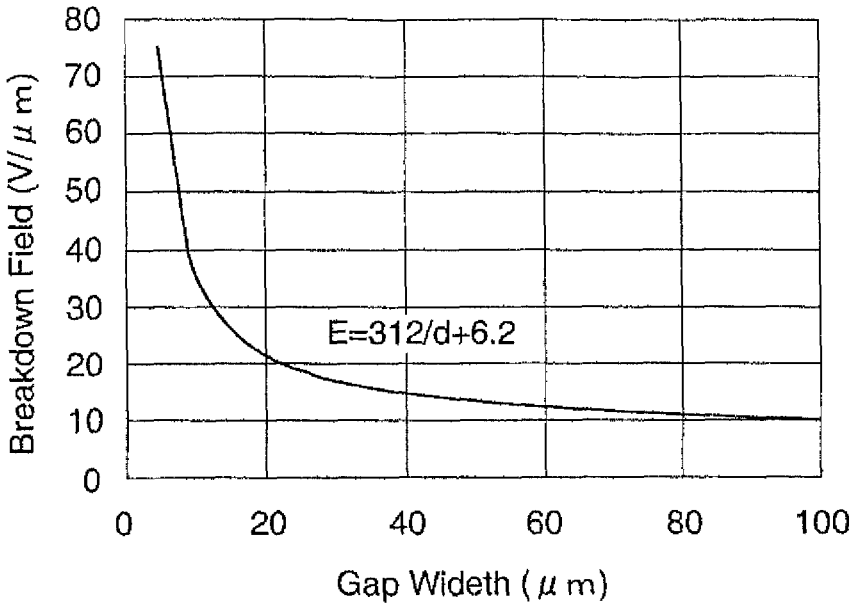
FIG. 4 is a graph illustrating a relationship between a gap between the recording paper and an intermediate transfer belt, and a discharge start electric field generated between the recording paper and the intermediate transfer belt.

More specifically, the transfer of the toner image T to the recording paper 5 of which the front surface is not smooth as the rough paper and of which the density is low, as schematically illustrated in FIG. 3A, may be favorably performed by coming into contact with the intermediate transfer belt 21 supported by the belt support roll 25 and the secondary transfer roll 31 via the rough paper by a normal and relatively strong pressing force and by the action of the strong nip pressure to the rough paper. In contrast, in a case where the gap forming member is inserted by the gap forming member driving unit (not illustrated) between the intermediate transfer belt 21 and the secondary transfer roll 31 in order to suppress the occurrence of the image defect known as the banding, as illustrated in FIG. 3B, the gap G is generated between the intermediate transfer belt 21 and the secondary transfer roll 31, and the distance between the electric charges for the transfer having the positive polarity supplied from the secondary transfer roll 31 to the rear surface of the rough paper and the toner image T charged to the negative polarity on the intermediate transfer belt 21 increases. Therefore, in this case, the transfer electric field that acts on the toner image T on the intermediate transfer belt 21 is weakened and intense discharge is likely to occur in the gap G. Therefore, it is difficult to ensure transferability. The discharge that occurs in the gap G formed between the toner image T on the intermediate transfer belt 21 and the recording paper 5, as illustrated in FIG. 4, is in inverse proportion to a size of the gap G and a discharge start electric field decreases as the gap G becomes larger (discharge occurs in the low electric field).

Therefore, in order to achieve both of a suppression of the banding in and an improvement of the image transferability for the recording paper 5, such as the cardboard, especially as the rough paper, having a basis weight relatively higher than that of the plain paper and having a front surface which is not smooth, the exemplary embodiment is configured to include a gap forming unit and an electric charge applying unit. The gap forming unit forms a gap between the intermediate transfer belt 21 and the secondary transfer roll 31 in at least one of a leading end and a trailing end of the recording paper 5 in the transport direction, of the recording paper 5. The electric charge applying unit applies electric charges having an opposite polarity (positive polarity) to a charging polarity of a toner which forms a toner image, to a region on the recording paper 5 in which the gap is formed by the gap forming unit on an upstream side of the secondary transfer roll 31 along the transport direction of the recording paper 5.

In the exemplary embodiment, as illustrated in FIG. 2, a pre-charging device 80 is provided which is an example of a electric charge applying unit The pre-charging device 80 is disposed on the upstream side of the secondary transfer nip portion T2 along the transport direction of the recording paper 5 and on a downstream side of the pair of sheet transport rolls 54. The pre-charging device 80 applies the electric charges having the opposite polarity (positive polarity) to the charging polarity of the toner, to both of the leading end 5*b* and the trailing end 5*a*, in the transport direction, of the recording paper 5. This pre-charging device 80 is disposed at the position corresponding to the transporting guide 55 and on the downstream side of the pair of sheet transport rolls 54 along the transport direction of the recording paper 5. The exemplary embodiment is configured so that the pre-charging device 80 applies the electric charges having the opposite polarity (positive polarity) to the charging polarity of the toner, to both of the leading end 5*b* and the trailing end 5*a* of the recording paper 5 in the transport direction.

The pre-charging device 80 is disposed at the position separated by approximately 10 mm to 100 mm on the upstream side of the secondary transfer nip portion T2 along the transport direction of the recording paper 5. The pre-charging device 80 is preferably disposed as close as possible to the secondary transfer nip portion T2. This is because even for the rough paper having a relatively high resistance value, electric charges applied onto the front surface of the recording paper 5 by the pre-charging device 80 rapidly attenuate. The distance between the pre-charging device 80 and the secondary transfer nip portion T2 is mainly determined by the transporting speed of the recording paper 5. If it is considered that the electric charges applied to the recording paper 5 by the pre-charging device 80 attenuate while the electric charges reaches the secondary transfer nip portion T2, the resistance value of the recording paper 5 makes a large contribution. However, the pre-charging device 80 may be disposed at an optimum position with respect to the recording paper 5 having the relatively high resistance value. The reasons are as follows. That is, in a case of a medium resistance paper or a low resistance paper in which the electric charges attenuate rapidly, the same effect as applying the electric charges to the front surface of the recording paper 5 may be expected not by applying the electric charges by the pre-charging device 80 but by the electric charges injected from the secondary transfer roll 31 being moved to the front surface side of the recording paper 5.

The pre-charging device 80, for example, is configured with a brush roll 81 obtained by being uniformly planted by unit of an electrostatic flocking of a conductive fiber at a required density in the outer periphery of a core metal member made of a metal such as a columnar stainless steel. As the pre-charging device 80, the charging roll that coats an elastic layer having conductivity and forms in a columnar shape on the outer periphery of the metallic core metal may be used. Furthermore, as the pre-charging device 80, the discharge device such as a corotron or a scorotron, the device having an acicular electrode, the device having a brush shape electrode, or the device having a serrated shape (detack-saw) may be used. In contrast, as the pre-charging device 80, in order to efficiently apply the desired electric charges to the cardboard that includes the relatively large uneven portion on the front surface such as the rough paper, it is desirable to use the device having the brush roll 81 or the brush shape electrode.

A high voltage current or a high voltage having the opposite polarity (positive polarity) to the charging polarity of the toner is applied to the brush roll 81 by a high voltage power supply 82. As the high voltage current or the high voltage applied to the pre-charging device 80, approximately 90 μA/3 kV to 4 kV is set in the case of the brush roll 81 and approximately 20 μA/2 kV is set in the case of the detack-saw. It is desirable that the high voltage current or the high voltage applied to the pre-charging device 80 is set to a different value by a charging efficiency of the pre-charging device 80, the thickness of the recording paper 5 or the resistance value.

Figure 5:
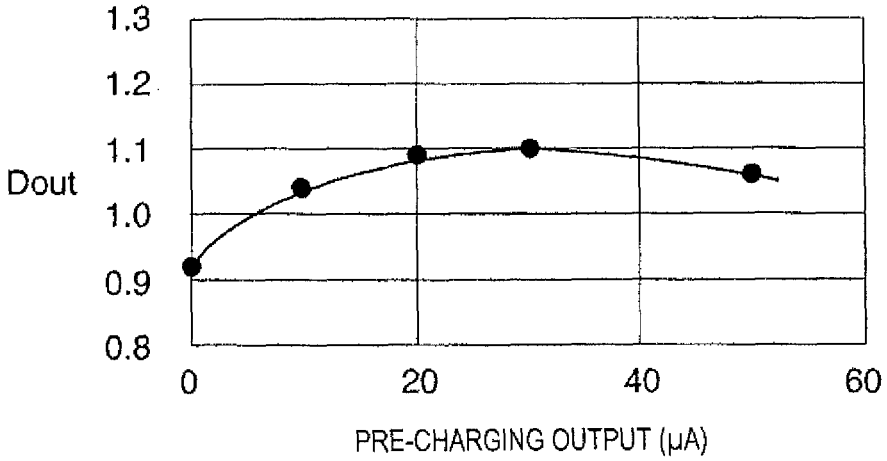
FIG. 5 is a graph illustrating the relationship between a transfer current that is applied to a pre-charging device and a density of the toner image transferred onto the recording paper.

FIG. 5 is the graph illustrating the result of an evaluation of the transferability of the toner image to the recording paper 5, by using the detack-saw as the pre-charging device 80 and assuming the current value applied to the pre-charging device 80 is equal to the electric charge amount applied to the recording paper 5. A horizontal axis represents an applied current value of the pre-charging device 80, and a vertical axis represents the density (Dout) of the toner image transferred to the recording paper 5, respectively. The transferability of the toner image is obtained by measuring the toner density (Dout) of the magenta color in a blue solid image. A layer configuration of the toner image T transferred onto the intermediate transfer belt 21 is provided with a lower layer having the toner image T of the magenta color and an upper layer having the toner image T of the cyan color in the blue solid image. Therefore, the transferability of the toner image is evaluated by measuring the toner density (Dout) of the toner image T of the magenta color that is the upper layer on the recording paper 5.

As is clear in FIG. 5, it is known that the toner image density (Dout) of the magenta color is increased and the transferability is improved by increasing the applied current to the pre-charging device 80. In contrast, in a case where the applied current to the pre-charging device 80 is too high, it is considered that a micro discharge occurs between the excessive electric charges applied onto the front surface of the recording paper 5 and the toner image T, and the toner having the low charging amount is charged to the opposite polarity and the density (Dout) of the toner image is reduced.

The transporting guide 55 facing the brush roll 81 includes a plarnar member having conductivity such as metal plate or the like and is connected (grounded) to the ground. The high voltage applied to the brush roll 81 by the high voltage power supply 82 controls the applied timing of the voltage or the current value (or voltage value) by the controller 100.

Figure 6:
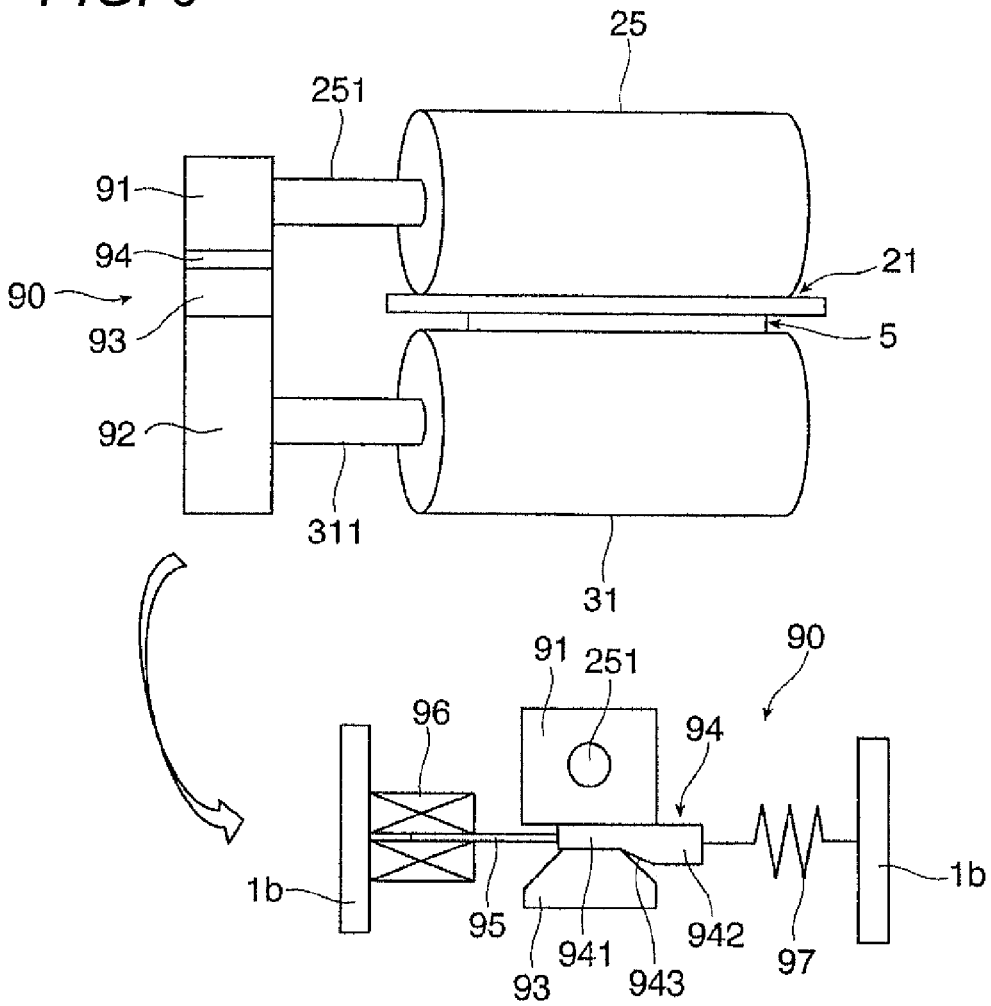
FIG. 6 is the configuration diagram illustrating a gap forming mechanism.

In the exemplary embodiment, a gap forming mechanism 90 is provided as the gap forming unit that forms the gap between the belt support roll 25 which supports the intermediate transfer belt 21 and the secondary transfer roll 31 in at least one of the leading end and the trailing end of the recording paper 5 in the transport direction of the recording paper 5. The gap forming mechanism 90 is configured as illustrated in FIG. 6. For convenience in understanding, FIG. 6 illustrates that the gap forming mechanism 90 is disposed on only one side of the secondary transfer roll 31. However, the gap forming mechanism 90 may be respectively disposed at both ends of the secondary transfer roll 31.

The belt support roll 25 as the rear surface support roll of the intermediate transfer belt 21, as illustrated in FIG. 6, is attached to be rotatable and in a state where the position is fixed to the frame (not illustrated) of the main body 1*a* of the image forming apparatus 1 via a rotation shaft 251. A support roll holding member 91 is disposed at the end portion of the rotation shaft 251 in the belt support roll 25. The support roll holding member 91 rotatably holds the rotation shaft 251 of the belt support roll 25. The secondary transfer roll 31 is attached to be rotatable to the frame (not illustrated) of the main body 1*a* of the image forming apparatus 1 via the rotation shaft 311 and in a state of being biased to come into contact with the belt support roll 25 at a required pressing force. A transfer roll holding member 92 is disposed at the end portion of the rotation shaft 311 in the secondary transfer roll 31. The transfer roll holding member 92 rotatably holds the rotation shaft 311 of the secondary transfer roll 31. The transfer roll holding member 92 is movably disposed in a direction to come into contact with or separate from the belt support roll 25.

Furthermore, a transfer roll positioning member 93 is movably disposed along the direction to come into contact with and separate from the belt support roll 25 between the support roll holding member 91 and the transfer roll holding member 92. The transfer roll positioning member 93 moves along the direction to come into contact with and separate from the transfer roll holding member 92 and the belt support roll 25. In addition, the transfer roll positioning member 93 may be integrally disposed with the transfer roll holding member 92.

A gap setting member 94 is disposed so as to be interposed between the support roll holding member 91 and the transfer roll positioning member 93. The gap setting member 94 is formed in a substantially flat plate shape. The gap setting member 94 includes a first setting portion 941 of which the thickness is formed to be relatively thin, a second setting portion 942 which is formed thicker than the first setting portion 941, and an inclined portion 943 which is formed between the first setting portion 941 and the second setting portion 942. The gap setting member 94 is provided with a guide member 95. The guide member 95 has a columnar shape and is disposed at an end surface of the first setting portion 941 so as to protrude. The guide member 95 is formed of a magnetic material such as a magnetic stainless steel or an iron. The leading end of the guide member 95 is movably inserted along the direction intersecting the axial direction of the secondary transfer roll 31 on the inner side of a pull type solenoid 96 as the driving unit disposed at a main body frame 1*b* of the image forming apparatus 1. Furthermore, the gap setting member 94 is biased in the right direction in the figure by a tension spring 97 as an example of an urging member attached to the end portion of the second setting portion 942 side.

In the gap forming mechanism 90, as illustrated in FIG. 6, in a case where the solenoid 96 is in an OFF state, the gap setting member 94 receives a tensile force of the tension spring 97 and is moved to the right side in the figure. Therefore, in the gap forming mechanism 90, the first setting portion 941 is interposed between the support roll holding member 91 and the transfer roll positioning member 93. Therefore, the secondary transfer roll 31 is disposed at the position close to the belt support roll 25 in accordance with the thickness of the first setting portion 941. At this time, the secondary transfer roll 31 is in contact with the belt support roll 25 via the intermediate transfer belt 21 at the required pressing force.

Figure 7:
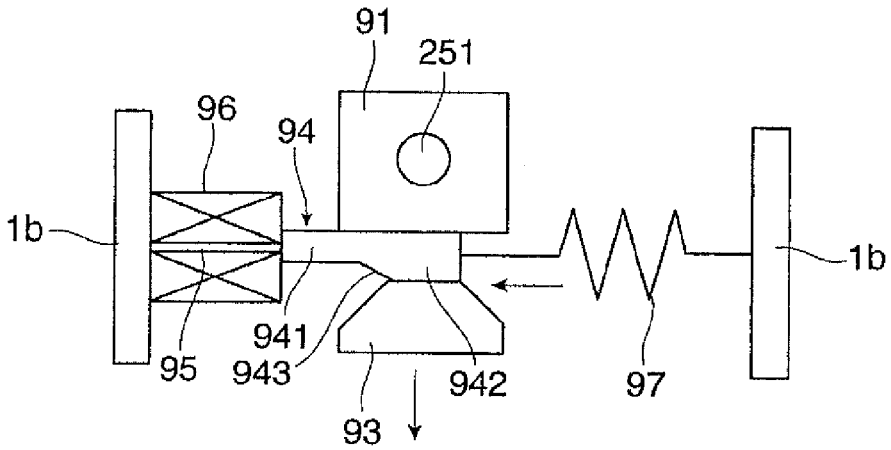
FIG. 7 is the configuration diagram illustrating an operation of the gap forming mechanism.

On the other hand, in the gap forming mechanism 90, as illustrated in FIG. 7, when the solenoid 96 is in an ON state, the guide member 95 of the gap setting member 94 receives a magnetic attractive force of the solenoid 96 and the gap setting member 94 moves in the left direction in the figure, and the second setting portion 942 of which a thickness is set to be thicker than that of the first setting portion 941 is interposed between the support roll holding member 91 and the transfer roll positioning member 93 via the inclined portion 943. Therefore, the secondary transfer roll 31 is disposed at the position separated from the belt support roll 25 only by the distance which is set in accordance with the thickness of the second setting portion 942. Accordingly, in this case, since the secondary transfer roll 31 is disposed at the position separated in advance from the belt support roll 25 only by the required distance, when the cardboard enters the secondary transfer nip portion T2, a displacement amount in which the secondary transfer roll 31 is separated from the belt support roll 25 is relatively small, and a variation amount of a contact pressure which acts between the secondary transfer roll 31 and the belt support roll 25 is reduced.

Operation of Characteristic Parts of Image Forming Apparatus

Hereinafter, the operation of the characteristic parts of the image forming apparatus 1 will be described.

In the image forming apparatus 1 according to the exemplary embodiment, as illustrated in FIG. 1, the required recording paper 5 is fed to the sheet feeding transport path 56 in accordance with the image forming operation by the paper feeding device 50. In the sheet feeding transport path 56, as illustrated in FIG. 2, the pair of sheet transport rolls 54 as the registration roll feeds the recording paper 5 to supply the paper to the secondary transfer nip portion T2 via the transporting guide 55 in accordance with the transfer time of the toner image T held on the intermediate transfer belt 21.

At that time, when it is determined that the recording paper 5 is the first and second cardboard haying the basis weight equal to or larger than 100 g/m$^2$, based on the signal from the operation and display section 102, the controller 100, as illustrated in FIG. 7, causes the secondary transfer roll 31 to be displaced in a direction separated from the belt support roll 25 over a required length L at the leading end 5*b* and the trailing end 5*a* of the recording paper 5, by turning ON/OFF the solenoid 96 of the gap forming mechanism 90 at a required timing. In addition, although the required length L, for example, is set to approximately 10 to 30 mm from the leading end 5*b* and the trailing end 5*a* of the recording paper 5, the required length L is not limited thereto.

Therefore, in the exemplary embodiment, when the recording paper 5 which is the cardboard enters the secondary transfer nip portion T2, the displacement amount of which the secondary transfer roll 31 is separated from the belt support roll 25 is relatively small, only by the amount corresponding to the displaced secondary transfer roll 31 in the direction separated from the belt support roll 25 by the gap forming mechanism 90. Therefore, the contact pressure between the secondary transfer roll 31 and the belt support roll 25 does not significantly change. Accordingly, in the image forming apparatus 1, as illustrated in FIG. 2, during the secondary transfer of the toner image T by using the secondary transfer roll 31 from the intermediate transfer belt 21 to the recording paper 5, it is possible to suppress a speed of the intermediate transfer belt 21 from varying at a time when the recording paper 5 made of the cardboard enters the secondary transfer nip portion T2 or at a time when the recording paper 5 exits from the secondary transfer nip portion T2, and it is prevented or suppressed that the image defect which is so-called banding occurs in the image transferred to the recording paper 5.

When it is determined that the recording paper 5 is paper having a basis weight relatively hider than that of the plain paper, such as especially the rough paper and having a front surface which is not smooth, as illustrated in FIG. 2, the controller 100 applies the high voltage having the opposite polarity (positive polarity) to the charging polarity of the toner to the brush roll 81 by the high voltage power supply 82, and applies the electric charges having the positive polarity over the required length L the leading end 5*b* and the trailing end 5*a* of the recording paper 5 by the brush roll 81.

Figure 8A:
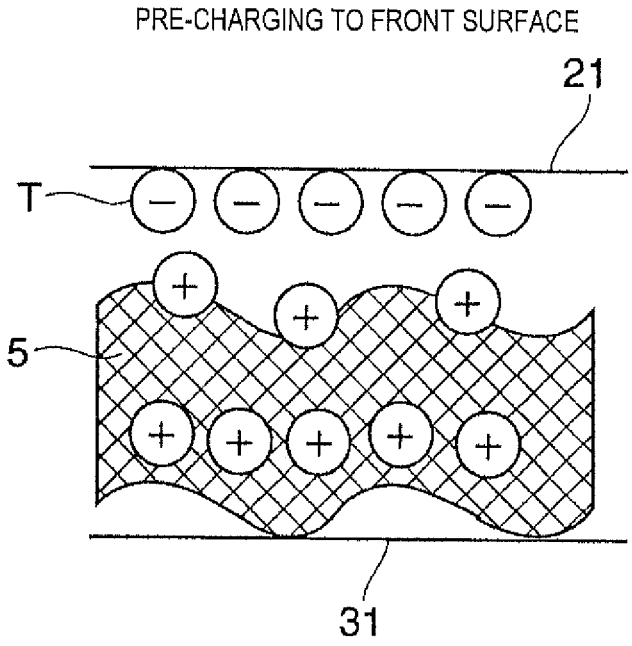
FIGS. 8A and 8B are schematic diagrams illustrating the toner image transferred onto the recording paper.

Therefore, as illustrated in FIG. 8A, the front surface of the recording paper 5 receives the electric charges of the positive polarity to be charged over a required length L at the leading end 5*b* and the trailing end 5*a*. Accordingly, in a case where the recording paper 5 moves to the secondary transfer nip portion T2 that is in contact with the intermediate transfer belt 21 and the secondary transfer roll 31, even when the recording paper 5 is the rough paper having the uneven portion on the front surface, the secondary transfer of the toner image T is promoted by an electrostatic attraction that acts between the electric charges having the positive polarity applied onto the front surface of the rough paper and the toner image T. Therefore, it is prevented or suppressed that the transfer failure occurs.

Figure 8B:
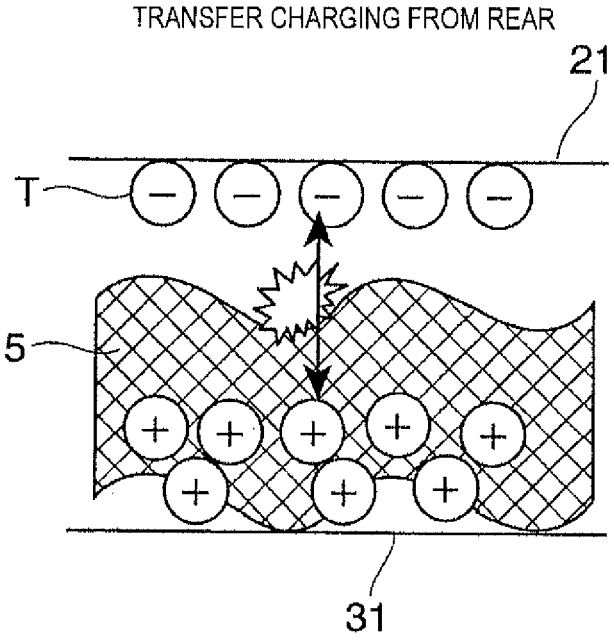

In contrast, in a case where the secondary transfer voltage that is applied to the secondary transfer roll 31 is set to a high value without using the pre-charging device 80 in order to improve the transferability of the toner image T to the recording paper 5 which is made of the rough paper and which includes an uneven portion on the front surface thereof, as illustrated in FIG. 8B, the discharging is likely to occur between the toner image T on the intermediate transfer belt 21 and the rear surface of the recording paper 5 to which the electric charges having the positive polarity are applied by the secondary transfer roll 31, and there is concern that the transfer failure occurs due to the toner that is charged to the opposite polarity along with the discharge.

In this manner, in the above-described exemplary embodiment, the transferability of the image with respect to the cardboard such as the rough paper may be improved.

In addition, in the above-described exemplary embodiment, although the case that is applied to the full-color image forming apparatus having the plural image forming device as the image forming apparatus is described, the image forming apparatus may be the monochrome image forming apparatus having only the single image forming device 10 (Y, M, C, K) as a matter of course.

The description has been given with reference to the case where the exemplary embodiment is applied to the secondary transfer device that serves as the transfer unit and transfers the toner image from the intermediate transfer body to the recording medium. The transfer unit may be applied to the transfer device that transfers the toner image from a photoconductor to the recording medium, as a matter of course.

Further, an electric charge amount applied by the electric charge applying unit may vary depending on whether a front surface of the recording medium is smooth or whether an image forming surface of the recording medium is a first surface or a second surface.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries a toner image;

a transfer unit that is disposed to contact the image carrier and transfers the toner image carried on the image carrier to a recording medium;

a gap forming unit that forms a gap between the image carrier and the transfer unit when one or more regions of the recording medium are positioned between the image carrier and the transfer unit, wherein the one or more regions comprise at least one of a leading end and a trailing end of the recording medium along a transport direction of the recording medium; and an electric charge applying unit that is disposed on an upstream side of the transfer unit along the transport direction of the recording medium and applies electric charges to the one or more regions of the recording medium, wherein the electric charges have an opposite polarity to a charging polarity of a toner which forms the toner image.

2. The image forming apparatus according to claim 1, wherein an electric charge amount applied by the electric charge applying unit varies depending on whether a front surface of the recording medium is smooth or whether an image forming surface of the recording medium is a first surface or a second surface.

* * * * *